US005870968A

United States Patent [19]

Dundorf

[11] Patent Number: 5,870,968

[45] **Date of Patent: *Feb. 16, 1999**

[54] POLE STRUCTURE FOR SUPPORTING A FLAG WITHOUT FURLING THEREABOUT

[76] Inventor: David Dundorf, 388 Shelbourne Ter., Ridgewood, N.J. 07450

[ * ] Notice: The terminal 26 months of this patent has been disclaimed.

[21] Appl. No.: 377,135

[22] Filed: Jan. 23, 1995

Related U.S. Application Data

[63] Continuation of Ser. No. 77,790, Jun. 16, 1993, Pat. No. 5,383,420.

[51] Int. Cl.[6] ..... G09F 17/00

[52] U.S. Cl. ..... 116/174; 116/173

[58] Field of Search ..... 40/607; 248/131, 248/240.3, 511; 384/275, 901; 116/173, 174

[56] References Cited

U.S. PATENT DOCUMENTS

| | | | |
|---|---|---|---|
| 689,077 | 12/1901 | Griffith . | |
| 756,989 | 4/1904 | Shur . | |
| 1,048,291 | 12/1912 | Buckley . | |
| 1,061,041 | 5/1913 | Buckley . | |
| 1,061,042 | 5/1913 | Buckley . | |
| 1,069,776 | 8/1913 | Foulis . | |
| 1,148,362 | 7/1915 | Dahlberg . | |
| 1,194,489 | 8/1916 | Earle . | |
| 1,236,417 | 8/1917 | Finn . | |
| 1,295,274 | 2/1919 | Crichton . | |
| 1,306,915 | 6/1919 | Klamroth . | |
| 1,554,758 | 9/1925 | Post | 116/173 |
| 1,855,824 | 4/1932 | Crichton . | |
| 2,072,573 | 3/1937 | Vigliotti | 116/173 |
| 2,672,118 | 3/1954 | Martin . | |
| 2,840,942 | 7/1958 | Ryan | 40/607 X |
| 2,853,046 | 9/1958 | Meade . | |
| 3,595,202 | 7/1971 | Visitacion . | |
| 3,798,808 | 3/1974 | VanWagenen et al. | 40/607 X |
| 5,044,301 | 9/1991 | Peters et al. . | |

FOREIGN PATENT DOCUMENTS

| | | | |
|---|---|---|---|
| 1419 | 1/1985 | Japan | 384/275 |

OTHER PUBLICATIONS

Product Brochure for the "Free Flyer" Flag Pole, from S & F Flag Pole Co.

Product Brochure for the "Tangle Free Wall Mount/Vertical Mount Flag Pole" sold in the Hard–to–Find Tools Catalog from Brookstone Company, Inc., Peterbourgh, New Hampshire.

*Primary Examiner*—William A Cuchlinski, Jr.
*Assistant Examiner*—Willie Morris Worth
*Attorney, Agent, or Firm*—Thomas J. Perkowski, Esq.

[57] ABSTRACT

An improved flag pole structure having a substantially uniform outer diameter along its entire longitudinal extent. The flag pole structure comprises a pole, a first bearing collar, a second bearing collar, a rotatable sleeve, and first and second flag support elements. The pole has a base portion and an upper end portion. The first bearing collar is mounted about the pole and between the base portion and the upper end portion, and has a first cylindrical sleeve bearing surface. The second bearing collar is fixedly mounted about the pole at the upper end portion thereof, and has a second cylindrical sleeve bearing surface. The rotatable sleeve is of rigid construction and disposed about the upper end portion of the pole. The rotatable sleeve also has first and second interior end surfaces which are adapted to bear against the first and second cylindrical sleeve bearing surfaces, respectively, so that the rotatable sleeve is free to rotate about the upper end portion of the pole. The first and second flag support elements are disposed along the rotatable sleeve in a spaced apart relationship, for operably connecting a flag to the rotatable sleeve. As the flag and the rotatable sleeve are free to rotate together about the pole in response to the flow of wind over the flag, without becoming furled about the pole. As a result of the present invention, a flag pole structure with an aesthetically pleasing structural appearance is provided. Owing to its simplicity, the flag pole structure is inexpensive to manufacture, easily to install, and highly reliable during year round operation.

9 Claims, 3 Drawing Sheets

POLE STRUCTURE FOR SUPPORTING A FLAG WITHOUT FURLING THEREABOUT

This is a Continuation Application of application Ser. No. 08/077,790, filed Jun. 16, 1993, now U.S. Pat. No. 5,383, 420, issued on Jan. 24, 1995.

BACKGROUND OF INVENTION

1. Field of Invention

The present invention relates to a flag pole structure which possess structural and functional characteristics that decrease the tendency of the flag which depends therefrom, to become furled or snagged about the pole as it responds naturally to wind and air currents.

2. Brief Description of the Prior Art

Flag poles are centuries old and have been used world over to support flags and banners in the display of patriotism, group membership, social movement, and the like.

Some flag poles are intended for vertical mounting, some for oblique mounting, and yet others for either type of mounting. With either of these general flag pole mounting techniques, there is a tendency for the flag to become furled or wrapped about the flag pole in response to wind or natural air currents flowing over the flag. To most people, this problem is disturbing as it detracts from the beauty of a flag being displayed.

Hitherto, a number of flag pole structures have been proposed in order to avoid the problem of flag furling. Prior art flag poles addressing this problem are disclosed in U.S. Pat. No. 689,077 to Griffith; U.S. Pat. No. 756,989 to Suhri; U.S. Pat. No. 1,048,291 to Buckley; U.S. Pat. No. 1,061,042 to Buckley; U.S. Pat. No. 1,061,041 to Buckley; U.S. Pat. No. 1,069,776 to Foulis; U.S. Pat. No. 1,148,362 to Dahlberg; U.S. Pat. No. 1,194,489 to Earle; U.S. Pat. No. 1,236,417 to Finn; U.S. Pat. No. 1,295,274 to Crichton; U.S. Pat. No. 1,306,915 to Klamroth; U.S. Pat. No. 1,554,758 to Post; U.S. Pat. No. 1,855,824 to Crichton; U.S. Pat. No. 2,672,118 to Martin; U.S. Pat. No. 2,853,046 to Meade; U.S. Pat. No. 3,595,202 to Visitacion; and U.S. Pat. No. 5,044, 301 to Peters.

However, each of these prior art flag pole designs suffers from one drawback or another as to make these flag pole constructions either commercially impracticable or undesirable. In particular, such prior art flag pole designs are either unnecessarily complicated, unattractive, or too costly to manufacture.

Thus, there is a great need in the art for an improved flag pole structure that is capable of supporting a flag or banner in a manner that the flag or banner does not become furled or snagged about the flag pole in response to the flow of wind or air currents thereover.

OBJECTS AND SUMMARY OF THE PRESENT INVENTION

Accordingly, it is a primary object of the present invention to provide an improved flag pole structure which is capable of supporting a flag in a manner that the flag does not become furled or wrapped about the flag pole structure in response to the flow of wind or air currents over the flag.

A further object of the present invention is to provide such a flag pole structure with substantially uniform outer dimensions to provide an aesthetically pleasing structural appearance that enhances the beauty of the flag being displayed.

A further object of the present invention is to provide such a flag pole structure that is inexpensive to manufacture, easily to install, and reliable.

These and further objects of the present invention will become apparent hereinafter.

BRIEF DESCRIPTION OF THE DRAWINGS

In order to more fully understand the Objects of the present invention, the Detailed Description of the Illustrative Embodiments set forth below is to be read in conjunction with the following drawings, in which.

DETAILED DESCRIPTION OF THE ILLUSTRATIVE EMBODIMENTS

Figure 1:
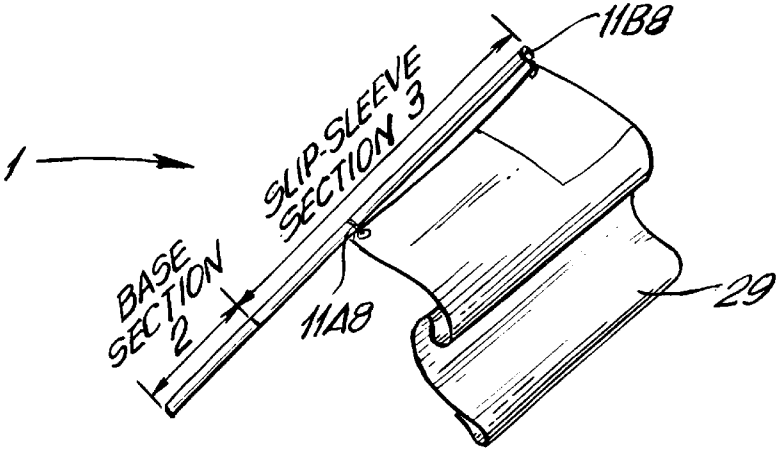
FIG. 1 is a perspective view of the flag pole structure of the present invention shown obliquely mounted with respect to the ground and supporting a flag in accordance with the principles of the present invention.

In FIG. 1, the flag pole structure of the present invention is shown supporting a flag, while being obliquely mounted in a conventional manner. As illustrated, flag pole structure 1 has a base portion 2 and an upper portion 3, each having an outer diameter of substantially constant dimensions along the entire longitudinal extent of the flag pole structure.

Figure 2A:
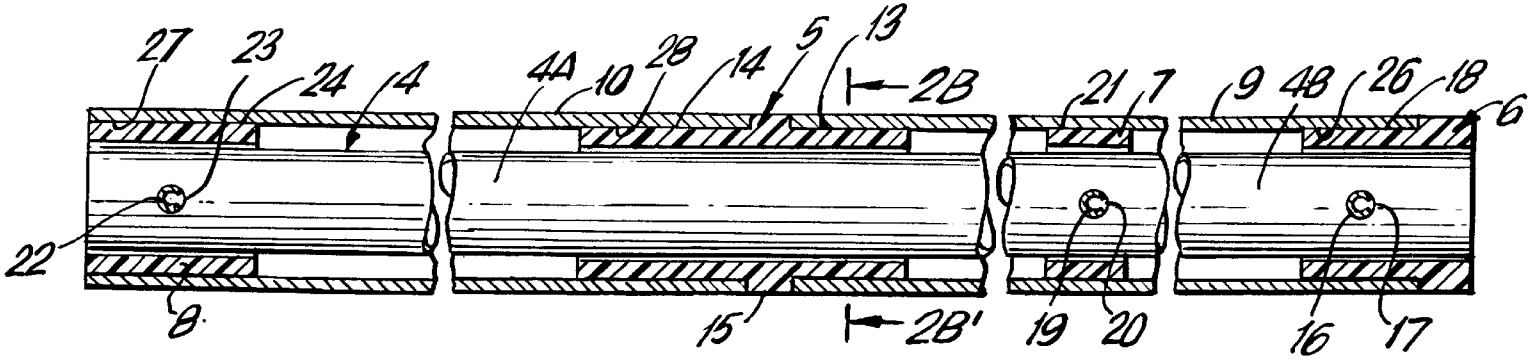
FIG. 2A is a cross-sectional view of the flag pole structure of a first illustrative embodiment of the present invention, taken along the longituditual extent thereof.
Figure 2:
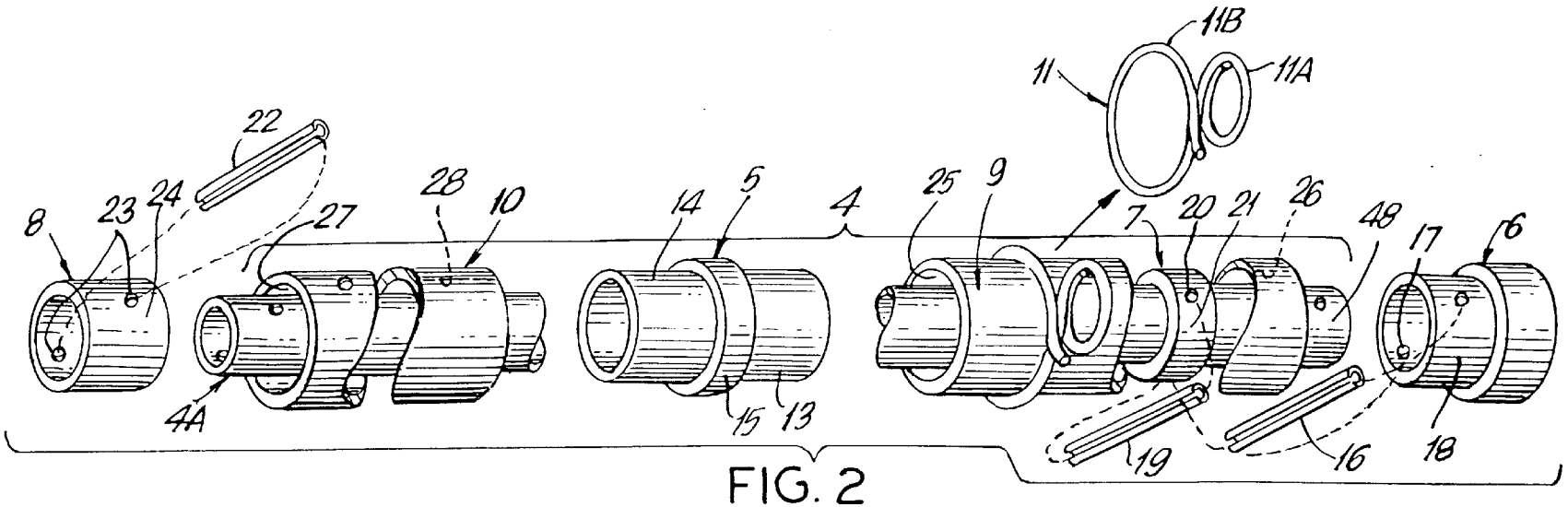
FIG. 2 is an exploded view of a first illustrative embodiment of the flag pole structure of the present invention.

As illustrated in FIGS. 2 and 2A, flag pole structure of the first illustrative embodiment comprises an assembly of structural and functional components, namely: a pole 4; a first bearing collar 5; a second cylindrical bearing collar 6; a third cylindrical bearing collar 7; a base collar 8; a rotational cylindrical sleeve 9; a stationary cylindrical sleeve 10; and first and second flag support elements 11A8 and 11B8. Pole 4 has a base portion 4A, and an upper end portion 4B. First cylindrical bearing collar 5 is mounted about pole 4 between the base portion and the upper end portion. First cylindrical bearing collar 5 has a first cylindrical sleeve bearing surface 13 and a first cylindrical sleeve engaging surface 14, spaced from surface 13 by an annular ring 15 having an outer diameter equal to the outer diameter of sleeves 9 and 10. Second bearing collar 6 is fixedly mounted about pole 4 at the upper end portion thereof by way of a spring pin 16 passing through a bore 17 formed in collar 6 and 4 pole. As shown, second bearing collar 6 also has a second cylindrical sleeve bearing surface 18. The third cylindrical bearing collar 7 is fixedly mounted about the pole between first and second cylindrical bearing collars 5 and 6 by way of a spring pin 19 passing through a bore 20 formed in collar 7 and pole 4. Collar 7 has a cylindrical bearing surface 21. Base collar 8 is fixedly mounted about the base portion of pole 4 by way of a spring pin 22 passing through bore 23 formed in collar 8 and pole 4. As shown, base collar 8 has a second cylindrical sleeve engaging surface 24.

Rotatable sleeve 9 has a rigid construction and is positioned about the upper end portion of the pole. As shown, the rotatable sleeve has first and second interior end surfaces 25 and 26. The interior surfaces are adapted to bear against first and second cylindrical sleeve bearing surfaces 13 and 18, respectively, so that the rotatable sleeve is free to rotate about the upper end portion of the pole and over third cylindrical sleeve bearing surface 21.

As illustrated in FIGS. 2 and 2A, the outer diameter $D_{RS1}$ of rotatable sleeve 9 is substantially equal to the outer diameter $D_{ss1}$ of stationary sleeve 10 along the entire longitudinal extent of the flag pole structure.

Stationary sleeve 10, like rotatable sleeve 9, has a rigid construction and is disposed about the base portion of the pole. Stationary sleeve 10 has first and second interior end surfaces 27 and 28, which are adapted to engage against and snap-fit (i.e. press-fit) about first and second cylindrical sleeve bearing surfaces 24 and 14, respectively.

Figure 2B:
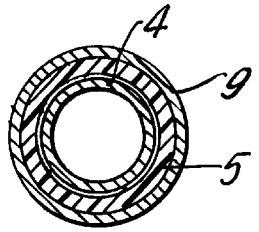
FIG. 2B is a cross-sectional view of the flag pole structure of the first illustrative embodiment, taken along line 2B–2B' of FIG. 2A.
Figure 2C:
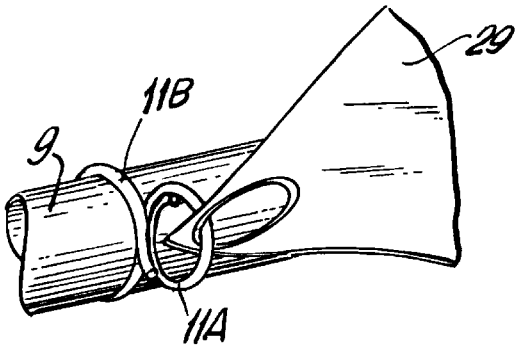
FIG. 2C is a perspective, fragmented view of the upper end portion of the flag pole structure of the first illustrative embodiment of the present invention.

First and second flag support elements 11A8 and 11B8 are disposed along rotatable sleeve 9 in a spaced apart relationship. As shown in FIG. 2C, each flag support element 11 has a first and second loop portions 11A and 11B, formed from a single piece of wire in a manner known in the art. First loop portion 11A is used to attach through a grommet in flag 29, whereas second loop portion encircles rotatable sleeve 9 in a secure fashion. The purpose of the flag support elements and is to operably connect a flag 29 to rotatable sleeve 9 so that in response to the flow to wind over the flag, the flag and the rotatable sleeve are free to rotate together about the pole, without becoming furled about the pole.

Figure 3:
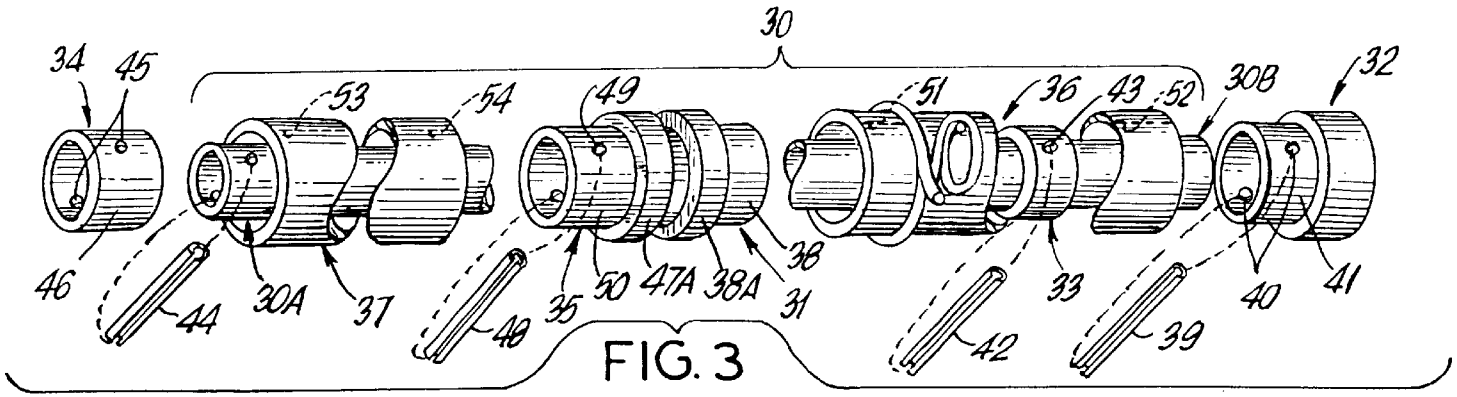
FIG. 3 is an exploded view of a second embodiment of the flag pole structure of the present invention.

In FIG. 3, the flag pole structure of the second illustrative embodiment is shown comprising an assembly of structural and functional components, namely: a pole 30; a first cylindrical bearing collar 31; a second cylindrical bearing collar 32; a third cylindrical bearing collar 33; a first base collar 34; a second base collar 35; a rotational cylindrical sleeve 36; a stationary cylindrical sleeve 37; and first and second flag support elements $11^1$ and $11^1$. Pole 30 has a base portion 30A, and an upper end portion 30B. In contrast with the first embodiment of the present invention, first cylindrical bearing collar 31 is slidably mounted about pole 30 between the base portion and the upper end portion. In this way, bearing collar 31 is free to rotate thereabout. First cylindrical bearing collar 31 has a first cylindrical sleeve bearing surface 38 and an annular flange 38A. Second cylindrical bearing collar 32 is fixedly mounted about pole 30 at the upper end portion thereof by way of a spring pin 39 passing through a bore 40 formed in collar 32 and pole 30. As shown, second bearing collar 32 has a second cylindrical sleeve bearing surface 41. The third cylindrical bearing collar 33 is fixedly mounted about the pole between first and second cylindrical bearing collars 31 and 32 by way of a spring pin 42 passing through a bore 43 formed in collar 33 and pole 30. As shown, first base collar 34 is fixedly mounted about the upper base portion of pole 30 by way of spring pin 44 passing through bore 45 formed in collar 35 and pole 30. First base collar 34 also has a first cylindrical sleeve engaging surface 46. Second base collar 35 is fixedly mounted to the lower base portion of pole 30 by way of a spring pin 48 passing through a bore 49 formed in collar 35 and pole 30. Second base collar 35 also has a second cylindrical sleeve engaging surface 50 and an annular flange 47A, which bears against flange 38A with minimal friction.

Figure 3A:
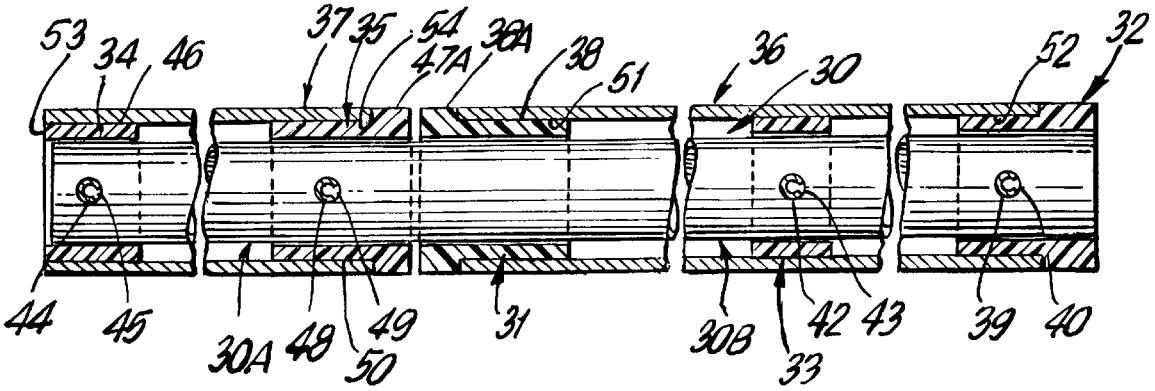
FIG. 3A is a cross-sectional view of the flag pole structure of a second illustrative embodiment of the present invention, taken along the longitudinal extent thereof.

Rotatable sleeve 36 has a rigid construction and is disposed about the upper end portion of the pole. As shown, rotatable sleeve 36 has first and second interior end surfaces 51 and 52. These interior surfaces are adapted to bear against first and second cylindrical sleeve bearing surfaces 38 and 41, respectively, so that the rotatable sleeve is free to rotate about the upper end portion of the pole and over second cylindrical sleeve bearing surface 53. As illustrated in FIGS. 3 and 3A, the outer diameter of rotatable sleeve 36 is substantially equal to the outer diameter of stationary sleeve 37 along the entire longitudinal extent of the flag pole structure.

Stationary sleeve 37, like the rotatable sleeve, has a rigid construction and is disposed about the base portion of the pole. As shown, the stationary sleeve has a first and second interior end surfaces 54 and 55, which are adapted to engage against and snap-fit (i.e. press-fit) about first and second cylindrical sleeve bearing surfaces, 46 and 50, respectively.

As in the first embodiment, first and second flag support elements $11^1$ and $11^1$ are provided along rotatable sleeve 36 in a spaced apart relationship. The purpose of these support elements is to operably connect a flag to rotatable sleeve 36 so that, in response to the flow to wind over the flag, the flag and the rotatable sleeve are free to rotate together about the pole, without becoming furled about the pole.

It is understood that the dimensions of the components of the flag pole structure of the illustrative embodiments will vary from embodiments from embodiment. Preferably, poles 30, rotatable sleeves 9, 36, and stationary sleeves 10, 37 are formed from aluminum or functionally equivalent tubing. Preferably, collars 5, 6, 7, 8, 31, 32, 33, 34 and 35 are manufactured from nylon, polytetrafluoroethylene, UHMW polyethylene, or other low friction material, machined to appropriate tolerances so as to achieve the above-described structural characteristics and functionalities. Preferably, UHMW polyethylene material is used, as it is a self-lubricating material which can be easily molded using conventional injection molding techniques.

If desired, ornamental objects, such as an eagle or ball, may be mounted onto the end of second bearing collar 6,32 in a manner known in the art.

While the preferred embodiment of the flag pole structure of the present invention has been described in detail, it will be appreciated that numerous variations and modifications will occur to persons skilled in the art. All such variations and modifications shall constitute the present invention as defined by the scope and spirit of the appended claims.

What is claimed is:

1. A flag pole structure having a longitudinal extent and capable of supporting a flag without furling thereabout in response to the flow of wind thereover, said flag pole structure comprising:

a pole having a base portion and an upper end portion, said base portion being supportable with respect to a stationary mount;

a first bearing collar, rotatably mounted about said pole and between said base portion and said upper end portion of said pole, and having a first cylindrical sleeve bearing surface;

a second bearing collar, fixedly mounted about said pole at said upper end portion of said pole, and having a second cylindrical sleeve bearing surface;

a first base collar, fixedly mounted about said base portion of said pole, and having a first cylindrical sleeve engaging surface;

a second base collar, fixedly mounted about said pole between said first base collar and said first bearing collar, and having a second cylindrical sleeve engaging surface;

a stationary sleeve of substantially rigid construction, disposed about said base portion of said pole, and having an outer diameter and first and second interior surfaces adapted to engage against said first and second cylindrical sleeve engaging surfaces, respectively, so that said stationary sleeve is stationarily disposed with respect to said pole;

a rotatable sleeve of substantially rigid construction, disposed about said upper end portion of said pole, and having an outer diameter and first and second interior end surfaces adapted to bear against said first and second cylindrical sleeve bearing surfaces, respectively, so that said rotatable sleeve is free to rotate about said upper end portion of said pole, said outer diameter of said rotatable sleeve being substantially equal to said outer diameter of said stationary sleeve along the entire extent of said flag pole structure; and first and second flag support elements, disposed along said rotatable sleeve in a spaced apart relationship, and arrange for operably connecting a flag to said rotatable sleeve so that, in response to the flow of wind over said flag, said flag and said rotatable sleeve are free to rotate together about said pole without said flag becoming furled about said pole structure.

2. The flag pole structure of claim 1, wherein said pole, said stationary sleeve and said rotatable sleeve are each realized in the form of first, second and third cylindrical tubes, respectively.

3. The flag pole structure of claim 2, wherein said first, second and third cylindrical tubes are each fabricated from metal.

4. The flag pole structure of claim 3, wherein said metal is aluminum.

5. The flag pole structure of claim 3, wherein said first and second bearing collars are fabricated from a self-lubricating material having low frictional characteristics.

6. The flag pole structure of claim 5, wherein said self-lubricating material is selected from the group consisting of nylon, polyethylene, and polytetraflourethylene.

7. The flag pole structure of claim 2, wherein said first and second bearing collars are each fabricated as injected-molded components.

8. The flag pole structure of claim 5, wherein said first and second interior surfaces of said stationary sleeve are adapted to engage against said first and second cylindrical sleeve engaging surfaces, respectively, in a press-fit manner so that said stationary sleeve is stationarily disposed with respect to said pole.

9. The flag pole structure of claim 1, wherein said first and second base collars are fixedly mounted about said base portion of said pole by way of first and second spring pins, respectively, and said second bearing collar is fixedly mounted about said pole at said upper end thereof by way of a third spring pin.

* * * * *